United States Patent [19]

Johne et al.

[11] 4,033,262

[45] July 5, 1977

[54] INK APPLICATOR FOR PRINTING APPARATUS

[75] Inventors: Hans Johne, Radebeul; Arndt Jentzsch, Coswig; Gunter Schumann, Radebeul, all of Germany

[73] Assignee: VEB Polygraph Leipzig Kombinat fur Polygraphische Maschinen und Ausrustungen, Leipzig, Germany

[22] Filed: Mar. 18, 1976

[21] Appl. No.: 668,923

[52] U.S. Cl. ..... 101/350; 101/DIG. 6

[51] Int. Cl.[2] ..... B41L 27/16

[58] Field of Search ..... 101/DIG. 6, 349, 350, 101/351, 352, 206, 207, 208, 209

[56] References Cited

UNITED STATES PATENTS

| | | | |
|---|---|---|---|
| 1,756,308 | 4/1930 | Schmidt | 101/349 |
| 1,860,957 | 5/1932 | Rutkoskie | 101/353 X |
| 1,981,912 | 11/1934 | Fankboner | 101/350 |
| 2,213,419 | 9/1940 | Taylor | 101/350 |
| 2,285,052 | 6/1942 | Roesen | 101/350 |
| 2,404,159 | 7/1946 | Barber | 101/349 X |
| 2,467,199 | 4/1949 | Faeber | 101/DIG. 6 |
| 3,020,840 | 2/1962 | Koch | 101/350 |
| 3,276,363 | 10/1966 | Kuchenbecker et al. | 101/349 |
| 3,651,758 | 3/1972 | Harrod | 101/350 |
| 3,683,805 | 8/1972 | Harless | 101/DIG. 6 |

*Primary Examiner*—J. Reed Fisher
*Attorney, Agent, or Firm*—Michael J. Striker

[57] ABSTRACT

An ink or liquid pickup roller is partially immersed in a bath of liquid and is rotated about a horizontal axis in one rotational sense. An applicator roller spaced from the pickup roller is rotated about its horizontal axis in the same rotational sense. A transfer roller is rotated in the opposite rotational sense about its horizontal axis and radially continuously engages the applicator roller. This transfer roller also is oscillated about the axis of the applicator roller into periodic contact with the roller to receive therefrom a coating of ink or other printing liquid. The transfer roller therefore rolls off the pickup and applicator rollers, but the peripheral velocities of the transfer roller is different from the peripheral velocities of the pickup and the applicator rollers.

7 Claims, 4 Drawing Figures

INK APPLICATOR FOR PRINTING APPARATUS

BACKGROUND OF THE INVENTION

The present invention relates to a method of and apparatus for applying a liquid to a roller. More particularly this invention concerns an inking or wetting mechanism for a printing roller.

In many printing processes a liquid, either ink in a normal printing process or water in an offset process, must be applied in an even coat to a roller, hereinafter referred to as the applicator roller. The liquid is usually held in a bath in which is partially immersed a pickup or ductor roller. A third roller, referred to as the fountain and transfer roller, is in constant radial contact with the applicator roller and is oscillated about the axis of the applicator roller so as to be brought into periodic contact with the pickup roller from which it takes liquid. The applicator roller usually rotates in the opposite sense as the pickup roller and drives the transfer roller so that it rotates in the same rotational sense as the takeup roller. Such mechanism is described in U.S. Pat. No. 2,788,741 or German Pat. No. 1,093,804. Since the transfer roller and the pickup roller rotate in the same rotational sense, their peripheries will move in opposite tangential directions at the point of radial contact between these two rollers.

Such arrangements have several disadvantages. First of all, they are subject to considerable wear since the drive for the transfer roller normally is only effective by friction contact with the applicator roller so that considerable load is put on the system when the transfer roller engages the pickup roller. Furthermore, the ink exchange from the pickup roller to the transfer roller invariably results in an isolated mass of ink or liquid to be applied to the transfer roller. Subsequent transfer of this ink or liquid to the applicator roller results in uneven printing results. Nonetheless, for most even transfer it is necessary that the relative peripheral velocities between the pickup roller and the transfer roller be maximized, and that the length of time they remain in contact similarly be maximized. For this reason the scraping effect between these two rollers, which leads to premature wear and breakdown of the system, must be augmented in order to receive best results. Even so, liquid is frequently applied to the transfer roller to in an uneven manner, requiring the applicator roller to in turn transfer it to several further applicator rollers in order to form a film of sufficiently uniform thickness for good printing.

SUMMARY OF THE INVENTION

It is therefore an object of the present invention to provide an improved method of and apparatus for applying a liquid to a roller.

Another object is the provision of an improved inking or wetting system which overcomes the above-given disadvantages.

Yet another object is to provide such a system wherein wear is minimized and the liquid is applied in a very uniform coat to the transfer roller.

These objects are attained according to the present invention in an arrangement wherein the pickup and applicator rollers are rotated in the same rotational sense and the transfer roller is rotated in the opposite rotational sense. Thus, the transfer roller effectively rolls off both the pickup roller and the applicator roller, greatly reducing wear and almost eliminating the damaging aspects of the scraping effect. Furthermore, the transfer roller is driven by the applicator roller not through a standard friction drive, but by means of gearing on the two shafts so that these rollers rotate at angular velocities forming a fixed ratio. The difference between the peripheral velocity of the pickup roller and that of the transfer roller is minimized so that liquid from the bath in which the pickup roller is immersed is transferred in a very even coat to the pickup roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
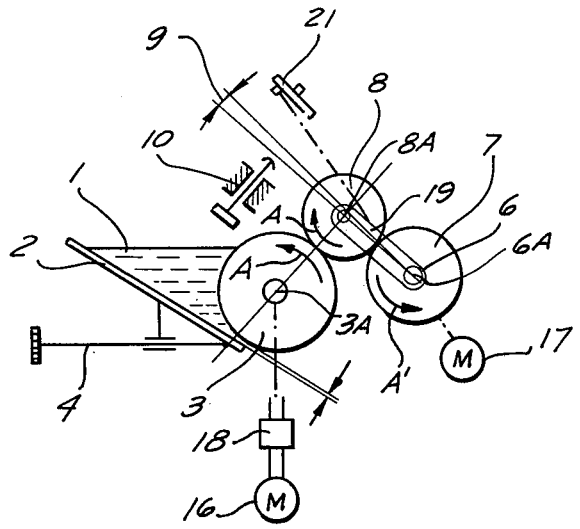
FIGS. 1 and 2 are side, partly schematic, views illustrating the system according to the present invention.

An inking mechanism is shown in FIG. 1 wherein a body of ink 1 is held in a reservoir formed in part by a plate 2 and one side of which is defined by the surface of a cylindrical roller 3 continuously rotated about its horizontal axis 3A in the rotational sense indicated by arrow A. The radial spacing 5 between the surface of the roller 3 and the plate 2 is controlled by a screw-type setting arrangement 4. This spacing 5 determines the thickness of the coating of the liquid 1 picked up by the roller 3 as it rotates. The motor 16 drives the roller 3 through a one-way coupling 18. In addition this motor 16 is adjustable so as to vary the angular speed of the cylinder 3 about its axis 3A.

An applicator roller 7 is carried on an axle 6 defining a horizontal axis 6A parallel to the axis 3A. A motor 17 is connected to this axle 6 in order to rotate this roller 7 continuously in the direction indicated by arrow A' which is the same rotational sense as that of the roller 3. The roller 7 is axially removable from the machine for different printing operations.

A distributing cylinder or transfer roller 8 is rotatable about a horizontal axis 8A and is carried on a pair of arms 19 pivoted on the axle 6. This roller 8 is in radial contact with the roller 7 at all times and gears such as shown at 20 in FIG. 3 on the shaft of the rollers 6 and 8 serve to rotate the roller 8 in the direction indicated by arrow A'', that is opposite to the directions of rotation of the rollers 7 and 3. A crank mechanism as indicated at 21 is connected to the arms 19 and serves to oscillate the rollers 8 back and forth about the axis 6A through the arc indicated at 9. Roll stops 10 engageable with the arms 19 serves to define a rest position for the roller A wherein it radially lightly contacts the roller 3.

In operation the roller 3 rotates continuously in the direction indicated by arrow A to pick up a thin film of the liquid 1. As the roller A oscillates back and forth it comes into contact with the roller 3, picking up from it a think film of liquid as the peripheral speeds of the two rollers 3 and 8 at their region of contact are only slightly different. Since the two rollers 3 and 8 roll off one another rather than moving in opposite directions at their point of contact a relatively uniform film of the ink 1 is taken up on the roller 8 and is then transferred to the roller 7 as the rollers 7 and 8 roll off one another. The rollers 7 and 8 do not rotate at the same peripheral velocity, so that the film of ink carried by the roller 3 is wiped off onto the roller 7. From the roller 7 the ink is applied to further rollers or to the printing plate. It is noted that the two rollers 3 and 8 need not rotate at the same peipheral velocity.

Since the roller 8 is only drivable at the speed established by motor 16 it will not be entrained by the roller 8. This prevents the roller 3 from picking up an excessive quantity of the liquid 1. Furthermore, the provision of gears 10 ensures that the film on the roller 8 will be very evenly applied to the roller 7, as these rollers need not press against one another with sufficient force to rotationally drive the roller 8 by means of friction with the surface of the roller 7. This also allows the contact time between the roller 8 and the roller 3 to be minimized. Thus, adjustment of the screw 4 has a very rapid effect on the coloration produced by the printer. The provision of the roll stops 10 also greatly reduces wear in the system.

Figure 2:
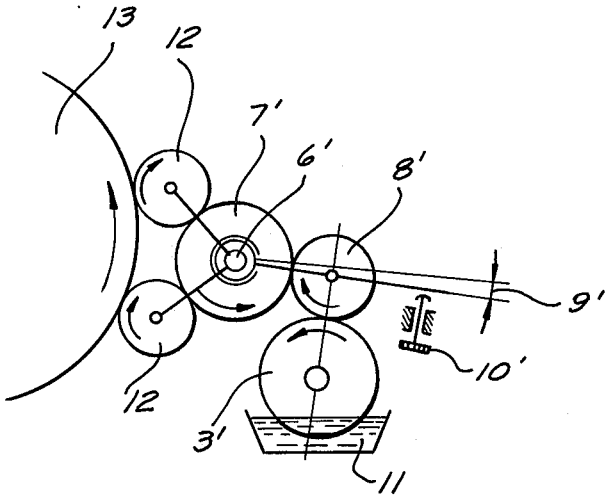

The arrangement shown in FIG. 2 uses the same reference numerals with primes for structure functionally identical to those of FIG. 1. Here, the pickup roller 3′ is immersed in a water bath 11 and is radially engageable with a counter-rotating transfer roller 8′ pivotal about the axis 6′ of the roller 7′. One or more further transfer rollers 12 may be provided between the roller 7′ and an offset drum 13. The position of the roller 8′ at the end of each of its oscillations as indicated at 9′ is defined by adjustable stops 10′. This arrangement is particularly useful for an offset process as any adjustment in the coloration at the roller 3′ will be almost immediately reflected in the printed product.

Figure 3:
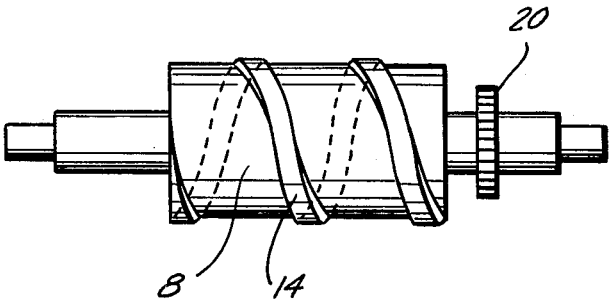
FIGS. 3 and 4 are side views of transfer rollers usable with the systems of FIGS. 1 and 2.
Figure 4:
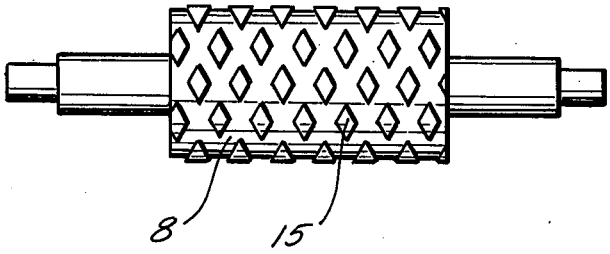

FIG. 3 shows how the roller 8 may be formed with a spiral ridge 14 extending helically around its periphery. It is also possible as shown in FIG. 4 to form this roller 8 on its surface with an array of rhombic bosses 15. Such formations greatly reduce the possiblility of clumping-up or building-up of the ink on the surface of the roller 8.

It will be understood that each of the elements described above, or two or more together, may also find a useful application in other types of applications differing from the types described above.

While the invention has been illustrated and described as embodied in an ink applicator for printing apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A liquid-applying apparatus comprising a bath of a liquid; a pickup roller having and being rotatable about a central axis and partially immersed in said bath; means for rotating said pickup roller about its axis in a predetermined rotational sense; an applicator roller spaced from said pickup roller and having and being rotatable about an axis parallel to the pickup roller axis; means for continuously rotating said applicator roller about its axis in the same rotational sense as said pickup roller at a predetermined peripheral speed; a transfer roller in radial contact with said applicator roller and having and being rotatable about an axis parallel to the pickup roller and applicator roller axes; means including a plurality of meshing gears one of which is fixed to said transfer roller and another of which is fixed to said applicator roller for continuously rotating said transfer roller about its axis in a rotational sense opposite to that of said pickup roller and that of said applicator roller and at a peripheral speed different from and forming a fixed ratio with said peripheral speed of said applicator roller; and means for oscillating said transfer roller about the applicator roller axis into periodic radial contact with said pickup roller.

2. The apparatus as defined in claim 1, further comprising a stop defining a rest position for said transfer roller in radial engagement with said pickup roller.

3. The apparatus as defined in claim 1, wherein said transfer roller has a profiled surface.

4. The apparatus as defined in claim 3, wherein said surface is formed with a helical ridge.

5. The apparatus as defined in claim 3, wherein said surface is formed with an array of bosses.

6. A method of operating a liquid-applying mechanism wherein a liquid pickup roller, a transfer roller, and an applicator roller are rotatable about respective parallel axes, said method comprising the steps of rotating said pickup roller about its axis in one predetermined rotational sense while in contact with said liquid; continuously rotating said applicator roller about its axis in the same rotational sense as said pickup roller and at a predetermined peripheral speed; continuously radially engaging said transfer roller against said applicator roller; oscillating said transfer roller about the axis of said applicator roller to bring said transfer roller into radial engagement with said pickup roller on each oscillation; and positively coupling said transfer and applicator rollers for continuous rotation of said transfer roller about its axis in a rotational sense opposite to that of said applicator and pickup rollers and at a peripheral speed different from and forming a fixed ratio with said peripheral speed of said applicator roller.

7. The method as defined in claim 6, wherein the angular velocity of said pickup roller is variable independently of the angular velocities of said applicator and transfer rollers.

* * * * *